US009203139B2

(12) United States Patent
Zhu et al.

(10) Patent No.: US 9,203,139 B2
(45) Date of Patent: Dec. 1, 2015

(54) ANTENNA STRUCTURES HAVING SLOT-BASED PARASITIC ELEMENTS

(75) Inventors: Jiang Zhu, Sunnyvale, CA (US); Jerzy Guterman, Mountain View, CA (US); Mattia Pascolini, Campbell, CA (US); Hongfei Hu, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 186 days.

(21) Appl. No.: 13/464,789

(22) Filed: May 4, 2012

(65) Prior Publication Data

US 2013/0293425 A1 Nov. 7, 2013

(51) Int. Cl.

| | |
|---|---|
| ***H01Q 1/24*** | (2006.01) |
| ***H01Q 1/38*** | (2006.01) |
| ***H01Q 1/52*** | (2006.01) |
| ***H01Q 9/42*** | (2006.01) |
| ***H01Q 13/10*** | (2006.01) |
| ***H01Q 21/28*** | (2006.01) |

(52) U.S. Cl.

CPC ..... *H01Q 1/243* (2013.01); *H01Q 1/521* (2013.01); *H01Q 9/42* (2013.01); *H01Q 13/10* (2013.01); *H01Q 21/28* (2013.01)

(58) Field of Classification Search

CPC ..... H01Q 1/243; H01Q 1/521; H01Q 21/28; H01Q 13/10; H01Q 9/42

See application file for complete search history.

(56) References Cited

U.S. PATENT DOCUMENTS

| | | | |
|---|---|---|---|
| 2,942,263 | A | 6/1960 | Baldwin |
| 3,490,025 | A | 1/1970 | Pickles |
| 4,509,056 | A | 4/1985 | Ploussios |
| 4,814,776 | A | 3/1989 | Caci et al. |
| 5,463,406 | A | 10/1995 | Vannatta et al. |
| 5,784,032 | A | 7/1998 | Johnston et al. |
| 5,917,458 | A | 6/1999 | Ho et al. |
| 6,031,503 | A | 2/2000 | Preiss et al. |
| 6,184,845 | B1 | 2/2001 | Leisten et al. |

(Continued)

FOREIGN PATENT DOCUMENTS

| | | |
|---|---|---|
| CN | 1682406 | 10/2005 |
| CN | 1776962 | 5/2006 |

(Continued)

OTHER PUBLICATIONS

Kough et al., U.S. Appl. No. 12/490,286, filed Jun. 23, 2009.

(Continued)

*Primary Examiner* — Trinh Dinh

(74) *Attorney, Agent, or Firm* — Treyz Law Group; G. Victor Treyz; Michael H. Lyons

(57) ABSTRACT

Electronic devices may include radio-frequency transceiver circuitry and antenna structures. The antenna structures may include antenna resonating elements and antenna ground plane structures. An electronic device may have antennas formed from the antenna resonating elements and an antenna ground plane. The antenna ground plane may have slot structures. The slot structures may be configured to form a slot-based parasitic antenna element to minimize coupling between the antennas in a device. The slot-based parasitic antenna element may be located between the antennas in a device. The slots structures from which a parasitic antenna element is formed may include open slots and closed slots. Slots may have one or more arms and one or more bends. Slots may be formed in internal housing members, traces on dielectric carriers, and other conductive structures.

11 Claims, 20 Drawing Sheets

(56) References Cited

U.S. PATENT DOCUMENTS

| | | | | |
|---|---|---|---|---|
| 6,414,643 | B2 | 7/2002 | Cheng et al. | |
| 6,429,818 | B1 | 8/2002 | Johnson et al. | |
| 6,456,249 | B1 | 9/2002 | Johnson | |
| 6,462,714 | B1 | 10/2002 | Okabe et al. | |
| 6,476,767 | B2 | 11/2002 | Aoyama et al. | |
| 6,483,466 | B2 | 11/2002 | Liu | |
| 6,486,836 | B1 | 11/2002 | Hill | |
| 6,552,692 | B1 | 4/2003 | Zeilinger et al. | |
| 6,570,538 | B2 | 5/2003 | Vaisanen et al. | |
| 6,639,558 | B2 | 10/2003 | Kellerman et al. | |
| 6,784,843 | B2 | 8/2004 | Onaka et al. | |
| 6,985,108 | B2 | 1/2006 | Mikkola | |
| 6,987,485 | B2 | 1/2006 | Ito et al. | |
| 7,042,418 | B2 | 5/2006 | Fujimura et al. | |
| 7,053,850 | B1 | 5/2006 | Bogdans et al. | |
| 7,068,229 | B2 | 6/2006 | Lin | |
| 7,072,623 | B2 | 7/2006 | Harano | |
| 7,173,567 | B2 | 2/2007 | Inatsugu et al. | |
| 7,187,339 | B2 * | 3/2007 | Mori | 343/770 |
| 7,205,942 | B2 | 4/2007 | Wang et al. | |
| 7,352,328 | B2 * | 4/2008 | Moon et al. | 343/700 MS |
| 7,545,327 | B2 | 6/2009 | Iellici et al. | |
| 7,595,759 | B2 | 9/2009 | Schlub et al. | |
| 7,629,930 | B2 | 12/2009 | Murch et al. | |
| 7,639,190 | B2 | 12/2009 | Shimasaki et al. | |
| 7,701,395 | B2 | 4/2010 | Alvey et al. | |
| 7,768,461 | B2 | 8/2010 | Cheng et al. | |
| 7,773,033 | B2 | 8/2010 | Morton et al. | |
| 7,804,458 | B2 | 9/2010 | Montgomery et al. | |
| 7,830,320 | B2 | 11/2010 | Shamblin et al. | |
| 7,830,322 | B1 * | 11/2010 | Oliver et al. | 343/770 |
| 7,916,089 | B2 | 3/2011 | Schlub et al. | |
| 7,973,722 | B1 | 7/2011 | Hill et al. | |
| 7,982,616 | B2 | 7/2011 | Banerjee et al. | |
| 8,144,063 | B2 | 3/2012 | Schlub et al. | |
| 8,482,471 | B2 | 7/2013 | Su | |
| 8,493,183 | B2 | 7/2013 | Yamagajp et al. | |
| 8,610,629 | B2 | 12/2013 | Pascolini et al. | |
| 2002/0190905 | A1 * | 12/2002 | Flint et al. | 343/702 |
| 2003/0193437 | A1 | 10/2003 | Kangasvieri et al. | |
| 2004/0145528 | A1 * | 7/2004 | Mukai et al. | 343/702 |
| 2004/0257283 | A1 * | 12/2004 | Asano et al. | 343/702 |
| 2005/0041624 | A1 | 2/2005 | Hui et al. | |
| 2006/0038736 | A1 | 2/2006 | Hui et al. | |
| 2006/0087333 | A1 * | 4/2006 | Li et al. | 324/754 |
| 2006/0109184 | A1 | 5/2006 | Chen et al. | |
| 2006/0139216 | A1 | 6/2006 | Glocker et al. | |
| 2006/0238437 | A1 | 10/2006 | Huang | |
| 2007/0069958 | A1 | 3/2007 | Ozkar | |
| 2008/0094302 | A1 | 4/2008 | Murch et al. | |
| 2008/0106478 | A1 | 5/2008 | Hill | |
| 2008/0143611 | A1 | 6/2008 | Wang | |
| 2008/0198082 | A1 * | 8/2008 | Soler Castany et al. | 343/770 |
| 2008/0258992 | A1 | 10/2008 | Tsai | |
| 2008/0316115 | A1 | 12/2008 | Hill et al. | |
| 2009/0009414 | A1 | 1/2009 | Reykowski | |
| 2009/0058358 | A1 | 3/2009 | Inoue et al. | |
| 2009/0174611 | A1 | 7/2009 | Schlub et al. | |
| 2009/0174612 | A1 | 7/2009 | Ayala et al. | |
| 2009/0262028 | A1 | 10/2009 | Mumbru et al. | |
| 2010/0072287 | A1 | 3/2010 | Kai et al. | |
| 2010/0073241 | A1 | 3/2010 | Vazquez et al. | |
| 2010/0073242 | A1 | 3/2010 | Vazquez et al. | |
| 2010/0073243 | A1 | 3/2010 | Vazquez et al. | |
| 2010/0123632 | A1 | 5/2010 | Hill et al. | |
| 2010/0156741 | A1 | 6/2010 | Vazquez et al. | |
| 2010/0220016 | A1 * | 9/2010 | Nissinen et al. | 343/702 |
| 2010/0231470 | A1 | 9/2010 | Lee et al. | |
| 2010/0238072 | A1 * | 9/2010 | Ayatollahi et al. | 343/700 MS |
| 2010/0238079 | A1 * | 9/2010 | Ayatollahi et al. | 343/729 |
| 2011/0115678 | A1 | 5/2011 | Owens | |
| 2011/0148736 | A1 | 6/2011 | Choi et al. | |
| 2012/0068893 | A1 * | 3/2012 | Guterman et al. | 343/702 |
| 2012/0068905 | A1 * | 3/2012 | Ayatollahi et al. | 343/841 |
| 2012/0169550 | A1 | 7/2012 | Schlub et al. | |
| 2012/0274522 | A1 * | 11/2012 | Ayatollahi | 343/745 |
| 2013/0050031 | A1 | 2/2013 | Zhu et al. | |
| 2013/0050050 | A1 | 2/2013 | Zhu et al. | |
| 2013/0127672 | A1 | 5/2013 | Zhu et al. | |
| 2013/0135158 | A1 * | 5/2013 | Faraone et al. | 343/702 |
| 2014/0043195 | A1 * | 2/2014 | Ho et al. | 343/770 |

FOREIGN PATENT DOCUMENTS

| | | |
|---|---|---|
| DE | 10248756 | 3/2004 |
| DE | 102007026965 | 1/2009 |
| EP | 1083622 | 3/2001 |
| EP | 1093098 | 4/2001 |
| EP | 1324425 | 7/2003 |
| EP | 1649546 | 4/2006 |
| EP | 2058716 | 5/2009 |
| EP | 2083472 | 7/2009 |
| EP | 2230717 | 9/2010 |
| TW | M311134 | 5/2007 |
| TW | I322388 | 3/2010 |
| WO | 2006018711 | 2/2006 |
| WO | 2011076582 | 6/2011 |

OTHER PUBLICATIONS

Petit et al., "MEMS-Switched Parasitic-Antenna Array for Radiation Pattern Diversity," IEEE Transactions on Antennas and Propagation, vol. 54, No. 9, Sep. 2006 (4 pages).

Kamal Sarabandi et al., "Subwavelength Radio Repeater System Utilitizing Miniaturized Antennas and Metamaterial Channel Isolator", IEEE Transactions on Antennas and Propagation, IEEE Service Center, Piscataway, NJ, US, vol. 59, No. 7, Jul. 1, 2011 (pp. 2683-2690), XP011369390.

* cited by examiner

ANTENNA STRUCTURES HAVING SLOT-BASED PARASITIC ELEMENTS

BACKGROUND

This relates to wireless electronic devices, and, more particularly, to antenna structures for wireless electronic devices.

Electronic devices such as computers and handheld electronic devices are often provided with wireless communications capabilities. For example, electronic devices may use cellular telephone circuitry to communicate using cellular telephone bands. Electronic devices may use short-range wireless communications links to handle communications with nearby equipment. For example, electronic devices may communicate using the WiFi® (IEEE 802.11) bands at 2.4 GHz and 5 GHz and the Bluetooth® band at 2.4 GHz.

To satisfy consumer demand for small form factor wireless devices, manufacturers are continually striving to implement wireless communications circuitry such as antenna components using compact structures. In such wireless devices, it may be desirable or necessary to locate antennas relatively close to one another. If care is not taken, however, there will be a potential for interference between the antennas.

It would therefore be desirable to be able to provide improved ways in which to provide electronic devices with antennas.

SUMMARY

Electronic devices may include radio-frequency transceiver circuitry and antenna structures. The antenna structures may include antenna resonating elements and antenna ground plane structures. Antennas may be formed from the antenna resonating elements and the antenna ground plane. Antennas may be located along the edge of a computer or other device that includes a display, at opposing ends of a cellular telephone or other handheld device, or may be located elsewhere within the housing of an electronic device.

The antenna ground plane may have slot structures. The slot structures may be configured to form a slot-based parasitic antenna element that enhances isolation between the antennas in a device. The slot-based parasitic antenna element may be located between the antennas in a device.

The slots structures from which a parasitic antenna element is formed may include open slots and closed slots. Slots may have one or more arms and one or more bends. Slots with L-shapes, C-shapes, T-shapes, H-shapes, and other suitable shapes may be formed.

In a device such as a cellular telephone or other portable equipment, an antenna ground plane may include conductive structures that are part of internal housing member such as a metal midplate member. Slot structures may be formed in the midplate member or other conductive structures in a device. In some configurations, parts of an antenna ground plane may be configured to form antenna cavity structures for the antennas in a device. Antenna ground plane structures and antenna resonating element structures may be formed from patterned traces on a dielectric support structure.

Further features of the invention, its nature and various advantages will be more apparent from the accompanying drawings and the following detailed description of the preferred embodiments.

DETAILED DESCRIPTION

Figure 1:
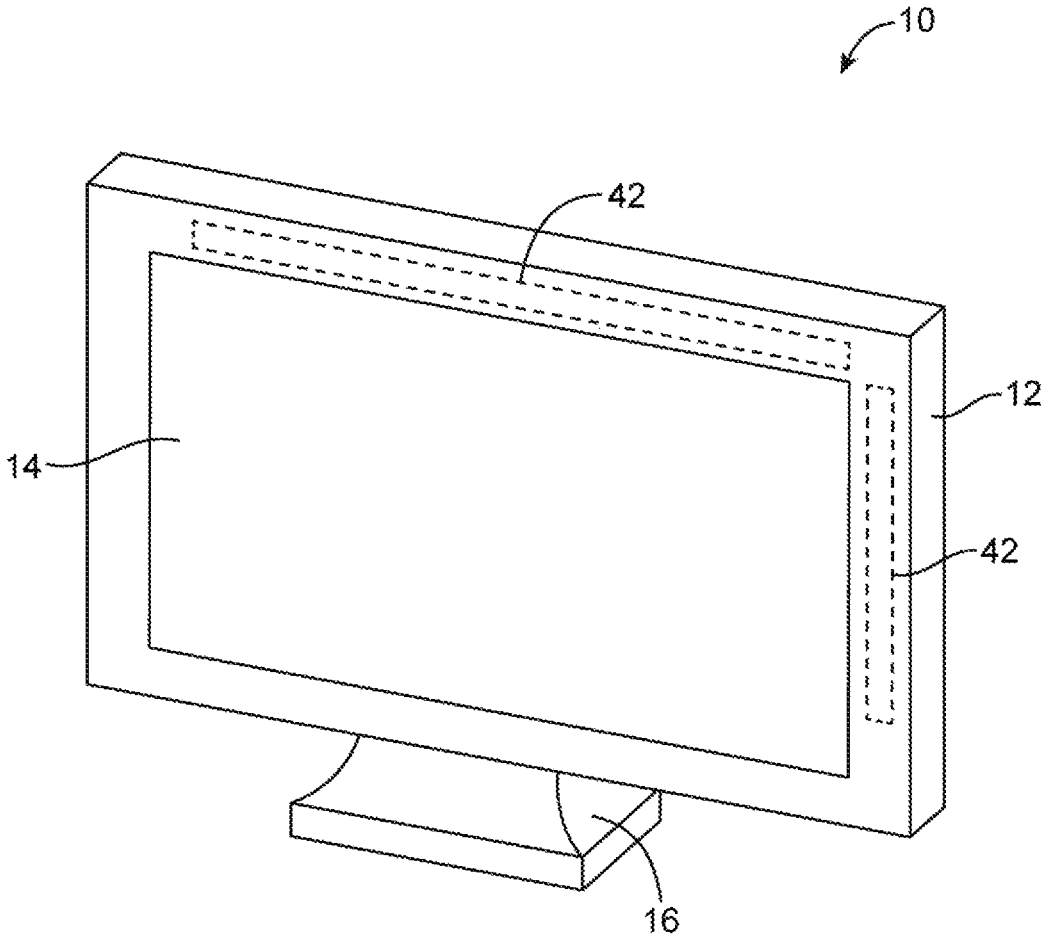
FIG. 1 is a perspective view of an illustrative electronic device such as a display with an integrated computer that may be provided with wireless circuitry in accordance with an embodiment of the present invention.
Figure 2:
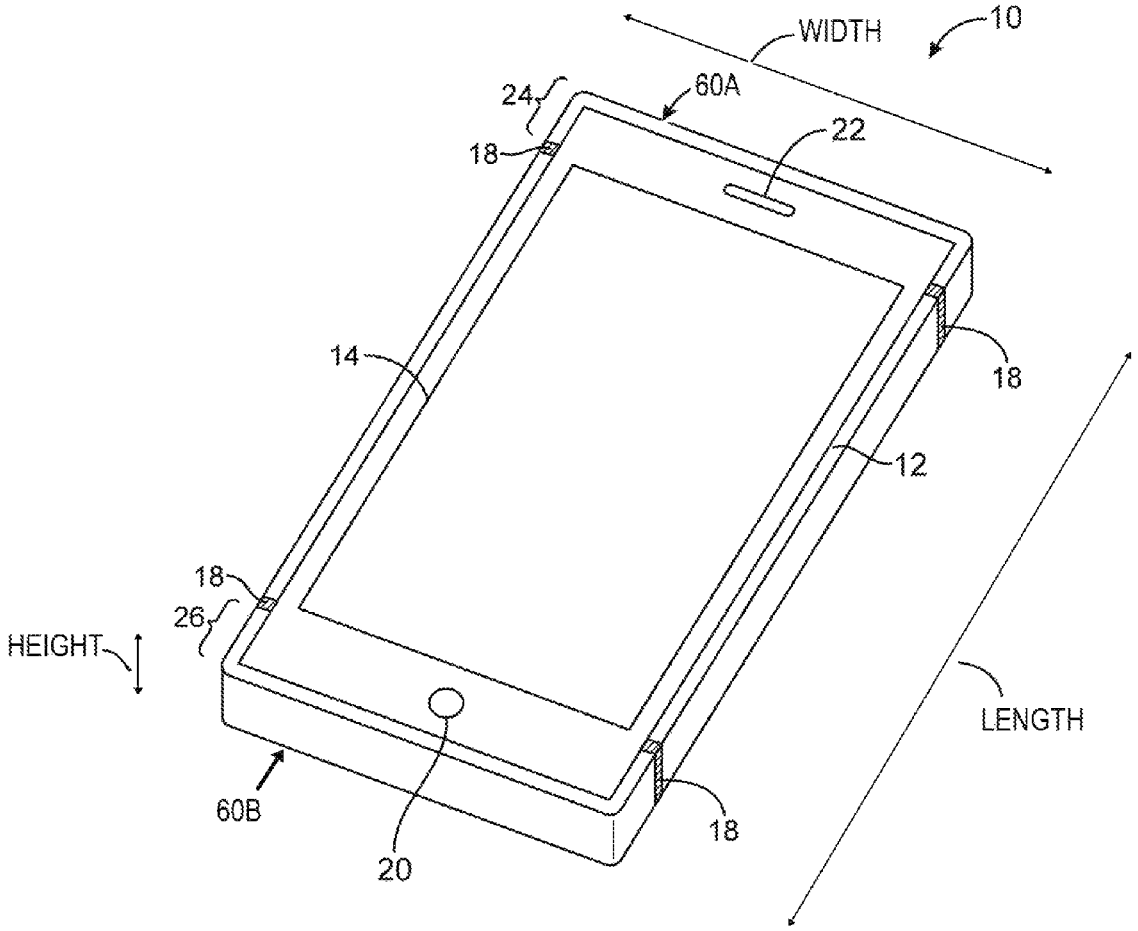
FIG. 2 is a perspective view of an illustrative electronic device such as a cellular telephone, tablet computer, or other portable device that may be provided with wireless circuitry in accordance with an embodiment of the present invention.
Figure 3:
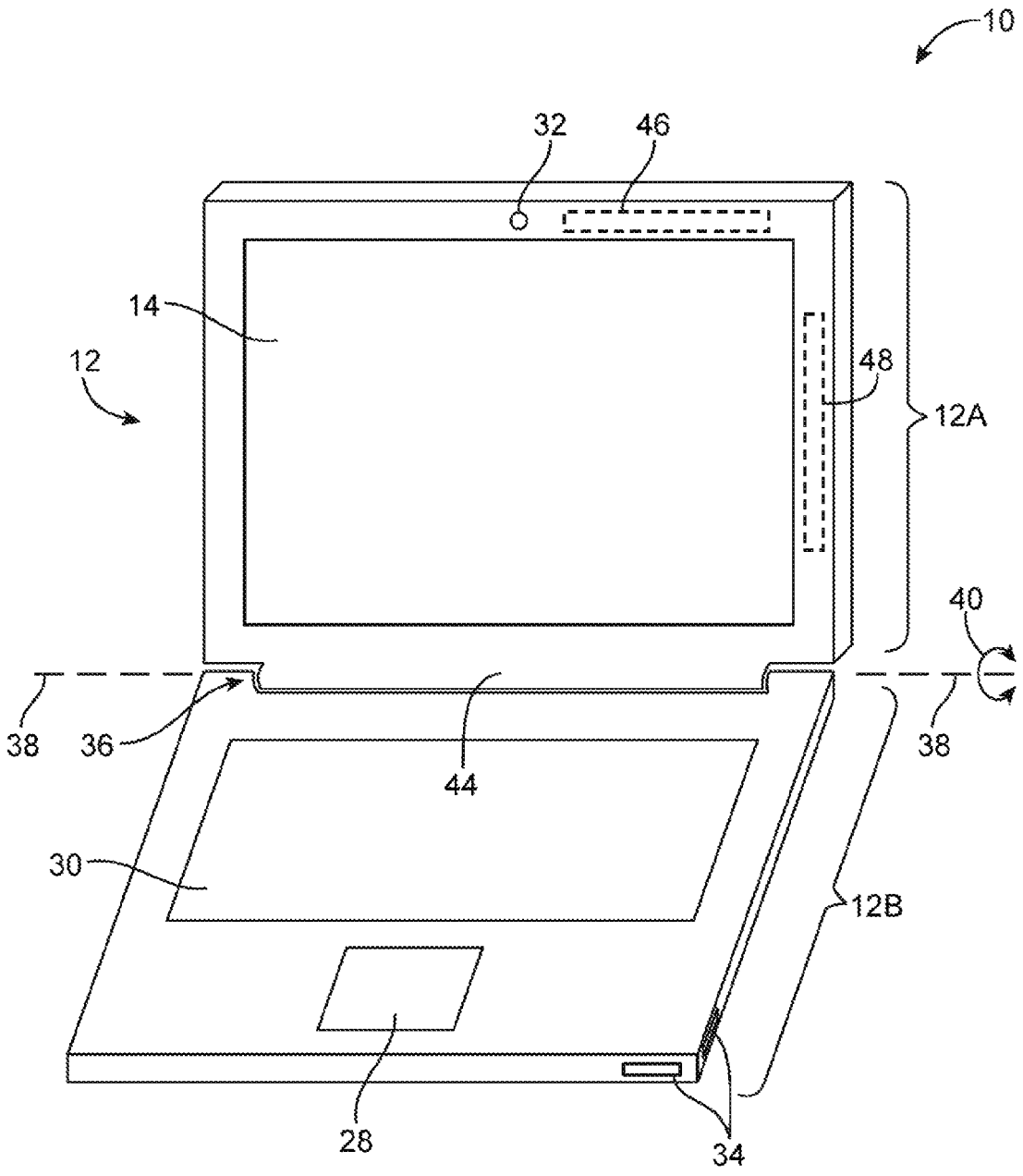
FIG. 3 is a perspective view of an illustrative electronic device such as a portable computer with wireless circuitry in accordance with an embodiment of the present invention.

Electronic devices such as electronic devices 10 of FIGS. 1, 2, and 3 may contain wireless circuitry. For example, an electronic device may contain wireless communications circuitry that operates in long-range communications bands such as cellular telephone bands and wireless circuitry that operates in short-range communications bands such as the 2.4 GHz Bluetooth® band and the 2.4 GHz and 5 GHz WiFi® wireless local area network bands (sometimes referred to as IEEE 802.11 bands). Devices such as device 10 of FIGS. 1, 2, and 3 may contain multiple antennas. The antennas may share a common antenna ground plane. Slot-based parasitic antenna element structures may be used to enhance isolation between the antennas.

In the illustrative configuration of FIG. 1, electronic device 10 has a display such as display 14 mounted in housing 12 on a stand such as stand 16. Electronic device 10 of FIG. 1 may be, for example, a computer monitor such as a computer monitor with an integrated computer or a television. In configurations such as the illustrative configuration of FIG. 2, electronic device 10 may be a handheld electronic device such as a mobile telephone, may be a portable media player, may be a tablet computer, or may be other portable electronic equipment. In the configuration of FIG. 3, electronic device 10 has a housing with multiple parts. Housing 12 of electronic device 10 of FIG. 3 may, for example, have upper housing 12A and lower housing 12B. Housing portions 12A and 12B may be coupled using a hinge. Device 10 of FIG. 3 may be a portable computer or other equipment with a multi-part housing.

In general, electronic devices such as devices 10 of FIGS. 1, 2, and 3 may be any suitable type of electronic device. Device 10 may be, for example, a handheld electronic device such as a cellular telephone, media player, gaming device, or other device, may be a laptop computer, tablet computer, or other portable computer, may be a desktop computer, may be a television or set top box, or may be other electronic equipment. The examples of FIGS. 1, 2, and 3 are merely illustrative.

Device 10 may have a housing such as housing 12. Housing 12 may be formed from plastic, metal (e.g., aluminum or stainless steel), fiber composites such as carbon fiber, glass, ceramic, other materials, and combinations of these materials. Housing 12 or parts of housing 12 may be formed using a unibody construction in which housing structures are formed from an integrated piece of material. Multipart housing constructions may also be used in which housing 12 or parts of housing 12 are formed from frame structures, housing walls, sheet metal structures and other planar structures, and other components that are attached to each other using fasteners, adhesive, and other attachment mechanisms.

Some of the structures in housing 12 may be conductive. For example, metal parts of housing 12 such as metal housing walls may be conductive. Other parts of housing 12 may be formed from dielectric material such as plastic, glass, ceramic, non-conducting composites, etc. To ensure that antenna structures in device 10 function properly, care should be taken when placing the antenna structures relative to the conductive portions of housing 12. If desired, portions of housing 12 may form part of the antenna structures for device 10. For example, conductive housing sidewalls, metal structures that are shorted to conductive housing sidewalls, or other internal metal housing structures may be used in forming an antenna ground plane element.

Device 10 may include a display such a display 14. Display 14 may be a liquid crystal display (LCD), a plasma display, an organic light-emitting diode (OLED) display, an electrophoretic display, an electrowetting display, or a display implemented using other display technologies. A touch sensor may be incorporated into display 14 (i.e., display 14 may be a touch screen display) or display 14 may be insensitive to touch. Touch sensors for display 14 may be resistive touch sensors, capacitive touch sensors, acoustic touch sensors, light-based touch sensors, force sensors, or touch sensors implemented using other touch technologies.

Antennas for devices such as device 10 of FIG. 1 may be located in peripheral edge portions of device 10 such as edge regions 42 or may be located in other portions of device 10 (e.g., in the center of the rear of housing 12, etc.). As an example, an array of two or more antennas may be located along the top edge or the right or left edge of device 10 of FIG. 1.

As shown in FIG. 2, housing 12 may include a peripheral conductive housing member separated into segments by optional dielectric gaps 18. The peripheral conductive housing member may be formed, for example, from a metal member such as a peripheral conductive housing band or a display bezel that runs around the four edges of rectangular housing 12. If desired, sidewall portions of housing 12 (e.g., left and right edge portions of a peripheral conductive housing structure or other sidewall structures) may be formed as integral portions of a rear housing structure in housing 12 (e.g., sidewalls that project vertically upwards along the edges of housing 12 from a rear planar portion) or may be formed as parts of other housing structures. Portions of housing 12 that are conductive may be formed from metals such as stainless steel or aluminum (as examples). Portions of housing 12 that are formed from dielectric may be formed from plastic, glass, ceramic, or other dielectric materials.

Device 10 may have a display cover layer such as a layer of glass or transparent plastic that covers display 14 and the front face of housing 12. Openings may be formed in the display cover layer such as an opening for buttons such as button 20 and openings for ports such as speaker port 22. Openings may be formed in housing 12 to accommodate connectors for digital and audio plugs and other components.

Antennas (e.g., antennas 60A and 60B) may be formed in regions 24 and 26 at the opposing top and bottom ends of device 10 or elsewhere in device 10. As an example, one or more cellular telephone antennas may be formed in region 24 and one or more wireless local area network antennas may be formed in region 26. As another example, cellular telephone antennas may be formed in both regions 24 and 26. Wireless local area network antennas may also be formed in region 24 and region 26. Other types of antennas may be formed in regions 24 and 26, if desired.

As shown in the illustrative configuration for electronic device 10 of FIG. 3, device 10 may have input-output devices such as track pad 28 and keyboard 30. Camera 32 may be used to gather image data. Device 10 may also have components such as microphones, speakers, buttons, removable storage drives, status indicator lights, buzzers, sensors, and other input-output devices. These devices may be used to gather input for device 10 and may be used to supply a user of device 10 with output. Ports in device 10 such as ports 34 may receive mating connectors (e.g., an audio plug, a connector associated with a data cable such as a Universal Serial Bus cable, a data cable that handles video and audio data such as a cable that connects device 10 to a computer display, television, or other monitor, etc.).

Device 10 may have a one-piece housing or a multi-piece housing. As shown in FIG. 3, for example, electronic device 10 may be a device such as a portable computer or other device that has a two-part housing formed from upper housing 12A and lower housing 12B. Upper housing 12A may include display 14 and may sometimes be referred to as a display housing or lid. Lower housing 12B may sometimes be referred to as a base or main housing. Housings 12A and 12B may be connected to each other using a hinge (e.g., a hinge located in region 36 along the upper edge of lower housing 12B and the lower edge of upper housing 12A). The hinge may allow upper housing 12A to rotate about axis 38 in directions 40 relative to lower housing 12B. The plane of lid (upper housing) 12A and the plane of lower housing 12B may be separated by an angle that varies between 0° when the lid is closed to 90° or more when the lid is fully opened.

Antennas for devices such as device 10 of FIG. 3 may be located in hinge region 44, along the upper edge of housing 12A in peripheral regions such as region 46, along the right-hand edge of housing 12A in peripheral regions such as region 48, on the left-hand edge of housing 12A, in a peripheral portion of housing 12B, in part of the planar center portion of housing 12A or 12B (e.g., under a dielectric antenna window formed within a planar metal housing member), or elsewhere in device 10.

Figure 4:
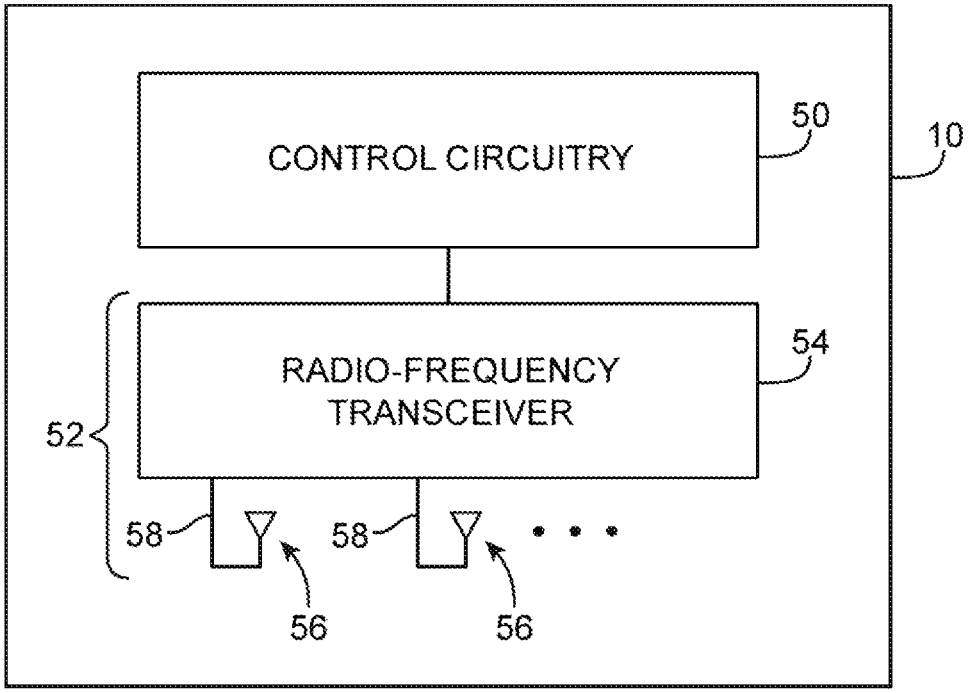
FIG. 4 is a diagram of illustrative wireless circuitry that may be used in an electronic device in accordance with an embodiment of the present invention.

As shown in FIG. 4, device 10 may include control circuitry 50. Control circuitry 50 may include storage such as flash memory, hard disk drive memory, solid state storage devices, other nonvolatile memory, random-access memory and other volatile memory, etc. Control circuitry 50 may also include processing circuitry. The processing circuitry of control circuitry 50 may include digital signal processors, microcontrollers, application specific integrated circuits, microprocessors, power management unit (PMU) circuits, and processing circuitry that is part of other types of integrated circuits.

Wireless circuitry 52 may be used to transmit and receive radio-frequency signals in devices such as the electronic devices of FIGS. 1, 2, and 3. Wireless circuitry 52 may include wireless radio-frequency transceiver 54 and one or more antennas 56 (sometimes referred to herein as antenna structures). Wireless transceiver 54 may transmit and receive radio-frequency signals from device 10 using antenna structures 56. Circuitry 52 may be used to support communications in one or more communications bands. Examples of communications bands that may be handled by circuitry 52 include cellular telephone bands, satellite navigation bands (e.g., the Global Positioning System band at 1575 MHz), bands for short range links such as the Bluetooth® band at 2.4 GHz and wireless local area network (WLAN) bands such as the IEEE 802.11 band at 2.4 GHz and the IEEE 802.11 band at 5 GHz, etc.

When more than one antenna is used in device 10, radio-frequency transceiver circuitry 54 can use the antennas to implement multiple-input and multiple-output (MIMO) protocols (e.g., protocols associated with IEEE 802.11(n) networks) and antenna diversity schemes. Multiplexing arrangements can be used to allow different types of traffic to be transmitted and received over a common antenna structure. For example, transceiver 54 may transmit and receive both 2.4 GHz Bluetooth® signals and 802.11 signals over a shared antenna.

Transmission line paths such as paths 58 may be used to couple antenna structures 56 to transceiver 54. Transmission lines 58 may include coaxial cable paths, microstrip transmission lines, stripline transmission lines, edge-coupled microstrip transmission lines, edge-coupled stripline transmission lines, transmission lines formed from combinations of transmission lines of these types, etc. During operation, antennas 56 may receive incoming radio-frequency signals. The received incoming radio-frequency signals may be routed to radio-frequency transceiver circuitry 54 by paths 58. During signal transmission operations, radio-frequency transceiver circuitry 54 may transmit radio-frequency signals. The transmitted signals may be conveyed by paths 58 to antenna structures 56 and transmitted to remote receivers.

One or more antenna components may be mounted within device 10. These antenna components may include active antenna components such as directly fed antenna resonating elements (sometimes referred to herein as "antenna resonating elements" or "resonating elements"). Antenna components in device 10 may also include passive (unfed) antenna components such as parasitic antenna resonating elements (sometimes referred to herein as parasitic elements, parasitic antenna element structure, or parasitic antenna elements). Parasitic antenna element structures may, if desired, be configured to serve as isolation structures that improve the isolation between antennas in device 10 and thereby improve wireless performance.

Figure 5:
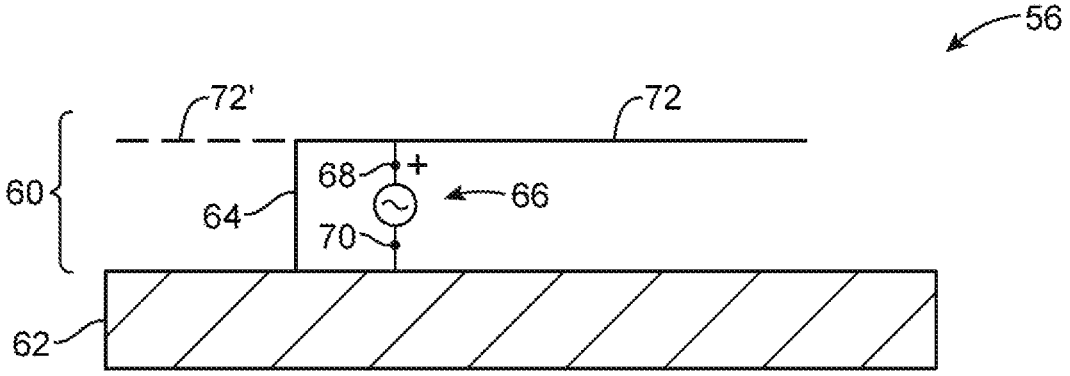
FIG. 5 is a diagram of an illustrative antenna resonating element of the type that may be used in wireless circuitry in accordance with an embodiment of the present invention.

An illustrative antenna for use in device 10 is shown in FIG. 5. Antenna 56 of FIG. 5 has antenna resonating element 60 and antenna ground plane 62. Antenna ground 62 and the conductive structures of antenna resonating element 60 may be formed from conductive housing structures such as portions of housing 12, from internal conductive housing structures such as metal frame members, metal midplate members, or other metal housing structures. Antenna ground 62 and antenna resonating element 60 may also be formed from metal traces on printed circuits (e.g., rigid printed circuit boards such as fiberglass-filled epoxy boards and/or flexible printed circuits formed from flexible sheets of polyimide or other polymer layers), metal traces on plastic carriers, glass carriers, ceramic carriers, or dielectric support structures formed from other dielectric materials or combinations of these materials, metal wires, metal foil, stamped sheet metal parts, and other conductive materials.

Antenna resonating element 60 may include a main resonating element arm such as arm 72. Antenna resonating element arm 72 may also include a short circuit branch such as short circuit branch 64 that couples main resonating element arm 72 to antenna ground 62. Antenna feed 66 may be coupled between main resonating element arm 72 and ground 62 in parallel with short circuit branch 64. Main resonating element arm 72 may, if desired, include one or more branches such as additional branch 72' (e.g., to form a T-shaped antenna). Branches of different lengths may be used, for example, to enhance the bandwidth of antenna 56. The main resonating element arm of antenna 56 may include straight lengths of conductor, conductive structures with curves, conductive structures with combinations of straight and curved edges, conductive structures that follow meandering paths, conductive structures that have bends, and other suitable antenna resonating element structures.

Antenna feed 66 may include a positive antenna feed terminal such as positive antenna feed terminal 68 and a ground antenna feed terminal such as ground antenna feed terminal 70. Transmission line conductors (e.g., a positive signal conductor and an associated ground signal conductor) may be coupled to terminals 68 and 70, respectively. The positive and ground transmission line conductors may be associated with a transmission line such as transmission line 58 of FIG. 4 and may be used to couple antenna 56 of FIG. 5 to radio-frequency transceiver circuitry. If desired, filters, switches, impedance matching circuits, connectors, and other components may be interposed in the transmission line path coupling radio-frequency transceiver circuitry 54 to antenna 56.

The illustrative antenna configuration of FIG. 5 forms an inverted-F antenna. If desired, other types of antennas may be used in device 10 such as patch antennas, planar inverted-F antennas, monopole antennas, dipole antennas, loop antennas, closed slot antennas, and open slot antennas, other suitable antennas, and hybrid antennas that include antenna resonating elements formed from two or more of these antenna structures. The illustrative inverted-F antenna configuration of antenna 56 of FIG. 5 is merely an example.

In device 10, multiple antennas 56 may be used to cover communications bands of interest. For example, multiple antennas may be used to cover the same communications band or multiple antennas may cover overlapping communications bands (as examples). To prevent antennas in device 10 from interfering with each other and thereby adversely affecting wireless performance, one or more isolation structures may be incorporated into device 10. As an example, one or more slot-based parasitic antenna elements that serve as antenna isolation structures may be incorporated into device 10.

Figure 6:
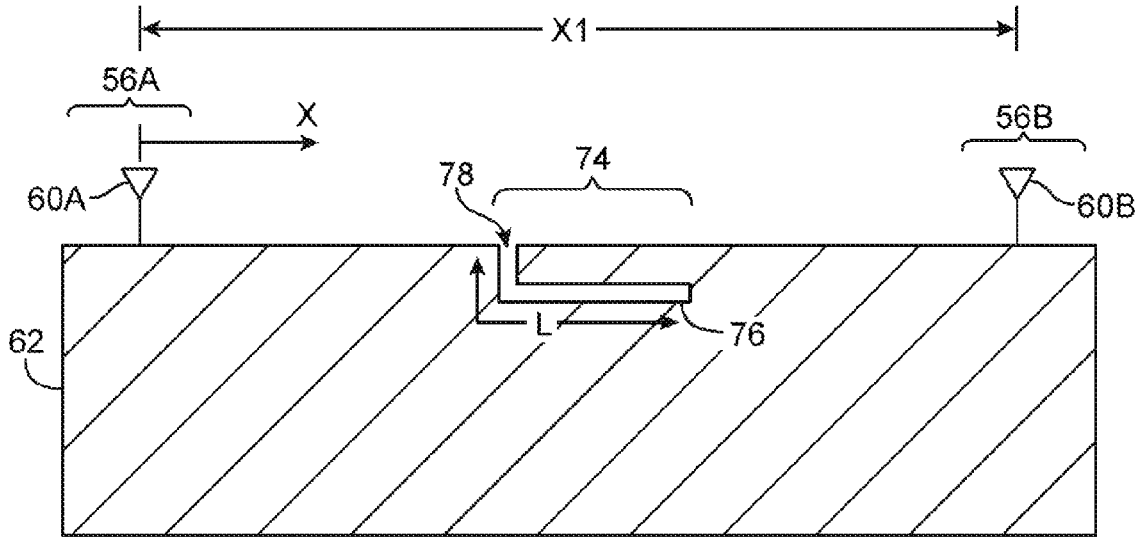
FIG. 6 is a diagram showing antennas may be isolated from each other using a slot-based parasitic antenna element in accordance with an embodiment of the present invention.

An illustrative antenna system for device 10 that includes a slot-based antenna isolation structure is shown in FIG. 6. As shown in FIG. 6, device 10 may include a first antenna such as antenna 56A and a second antenna such as antenna 56B. Antenna 56A and antenna 56B may be, for example, wireless local area network antennas, may be a wireless local area network antenna and a cellular telephone antenna, respectively, or may be a pair of cellular telephone antennas (as examples).

Antenna ground plane 62 may be shared by antennas 56A and 56B. Antenna ground plane 62 may, for example, include conductive housing structures, traces on a printed circuit, traces on a dielectric carrier, or combinations of conductive structures such as these that extend continuously past antenna resonating element 60A in antenna 56A and antenna resonating element 60B in antenna 56B.

Antenna 56A may include antenna resonating element 60 and a portion of antenna ground plane 62. Antenna 56B may be formed from antenna resonating element 60 and a portion of antenna ground plane 62. Slot-based parasitic antenna element 74 may be formed using one or more openings in ground plane 62 such as L-shaped slot 76. Slots such as slot 76 may sometimes be referred to open slots because one end of the slot (end 78) is open and is not surrounded and enclosed by ground plane 62.

Slot 76 may be characterized by a length L. The location of slot 76 along dimension X between antennas 56A and 56B and the magnitude of length L may be selected to reduce interference between antennas 56A and 56B. With one suitable arrangement, the length L of slot 76 may be about a quarter of a wavelength at an operating frequency of interest (e.g., at or near a communications band for which it is desired to minimize interference).

Figure 7:
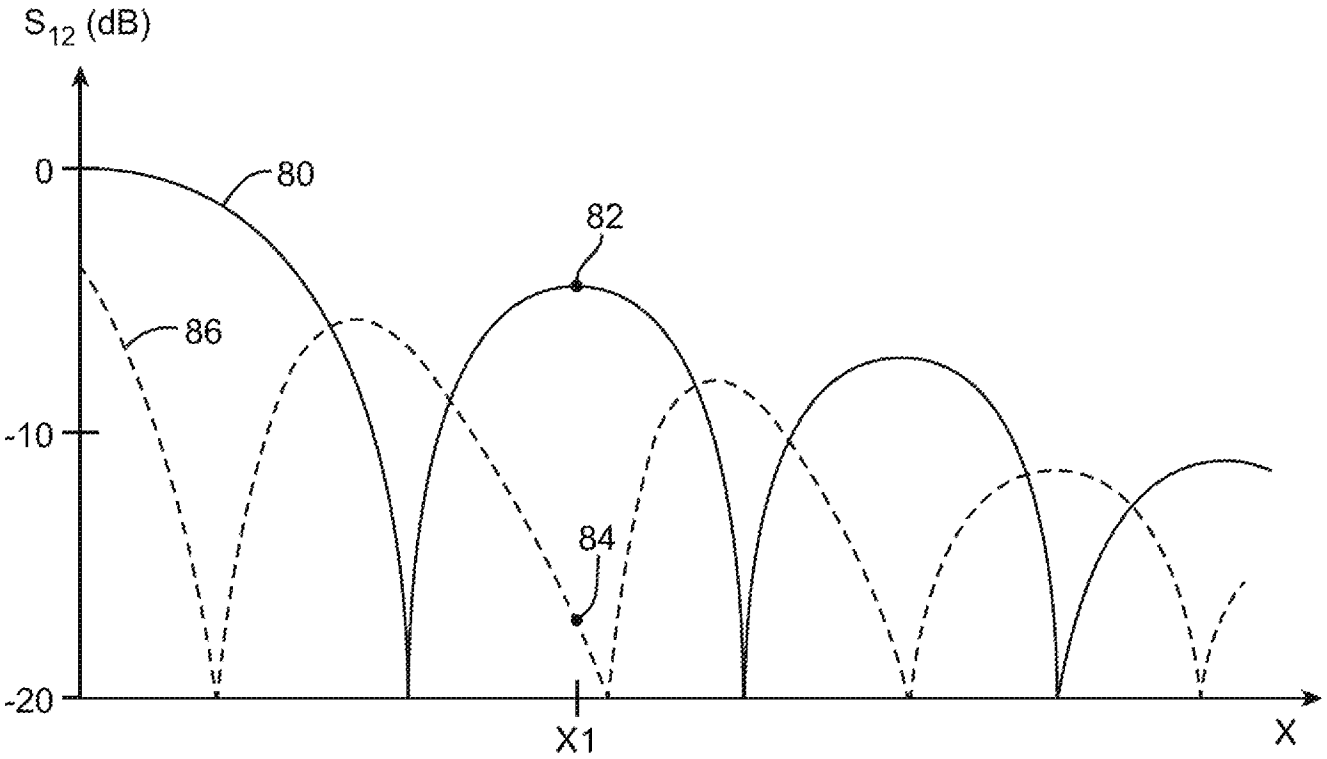
FIG. 7 is a graph in which antenna-to-antenna coupling has been plotted as a function of distance for antenna configurations with and without a slot-based parasitic antenna element in accordance with an embodiment of the present invention.

Interference between antennas 56A and 56B may result from ground plane coupling (i.e., currents coupled between antenna 56A and antenna 56B through ground plane 62) and from free space near-field electromagnetic coupling (i.e., radio-frequency electromagnetic fields coupled through the air and other dielectric materials between antennas 56A and 56B). FIG. 7 is a graph in which coupling between a first antenna (i.e., antenna 56A) and a second antenna (i.e., antenna 56B) has been plotted as a function of separation dimension X. Curve 80 corresponds to coupling (i.e., coupling parameter $S_{12}$ between first antenna 56A and second antenna 56B) in the absence of parasitic antenna element 74. Curve 86 corresponds to coupling ($S_{12}$) between the first antenna 56A and second antenna 56B in the presence of parasitic antenna element 74.

As shown in the graph of FIG. 7, the coupling characteristic of curve 80 may exhibit peaks and valleys as a function of increasing separation (dimension X) between antennas 56A and 56B. These peaks and valleys can be shifted (i.e., the coupling characteristic of curve 80 can change to the coupling characteristic of curve 86) due to the presence of parasitic antenna element 74 (e.g., due to current phase shifts within ground plane 62 due to the presence of slot 76).

Due to layout constraints, it may be desirable to locate antennas 56A and 56B within a device so that they are separated by a distance such as distance X1 (see, e.g., FIG. 6). In this type of scenario, the amount of coupling between antennas 56A and 56B in the absence of parasitic element 74 may be represented by point 82 on curve 80 of FIG. 7. When parasitic antenna element 74 is incorporated into device 10 as shown in FIG. 6, however, the amount of coupling between antennas 56A and 56B (in this example) may be reduced from the amount represented by point 82 on curve 80 to the amount represented by point 84 on curve 86. When configured to exhibit the relatively small amount of coupling of point 84 due to the presence of parasitic element 74, antennas 56A and 56B may exhibit minimal interference, thereby enhancing wireless performance for device 10.

The amount of isolation that is produced by incorporating slot-based parasitic antenna element 74 into device 10 may be adjusted by making adjustments to the location and shape of slot 76. For example, it may be desirable to slightly lengthen or shorten slot 76 or it may be desirable to move slot 76 so that opening 78 is closer to antenna resonating element 60A or is closer to antenna resonating element 60B. Adjustments may also be made to the shape of slot 76 (e.g., to add or remove slot branches, to use open and/or closed slot configurations, etc.) By optimizing the configuration of slot-based parasitic antenna element 74 in this way, antenna isolation and therefore wireless performance in device 10 may be maximized.

Figure 8:
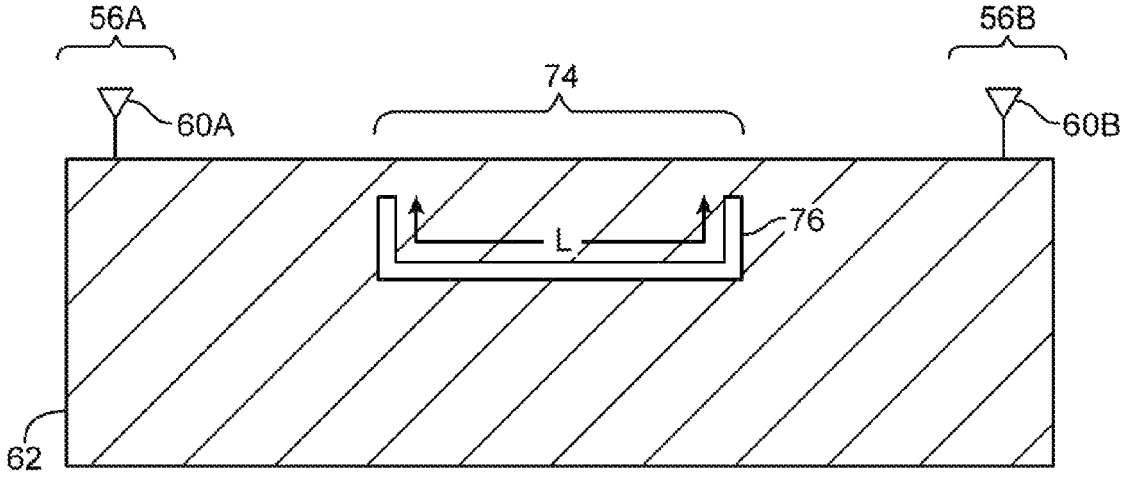
FIG. 8 is a diagram showing how a pair of antennas with a shared ground plane may be isolated using a parasitic antenna element formed from a C-shaped closed slot in the ground plane in accordance with an embodiment of the present invention.
Figure 9:
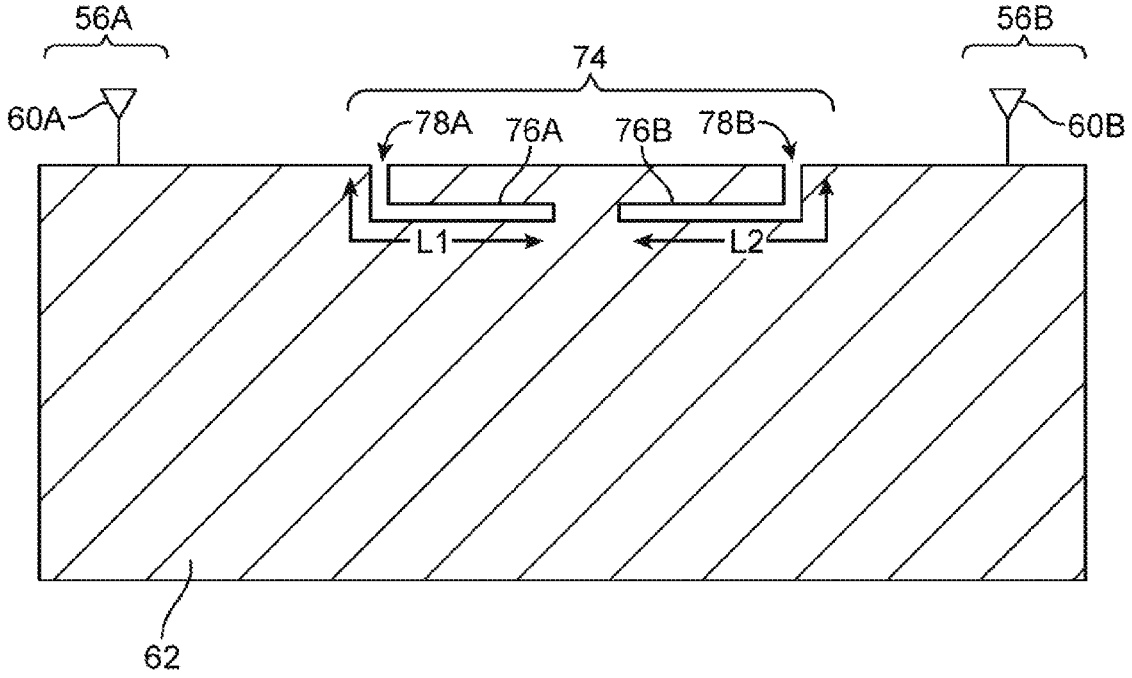
FIG. 9 is a diagram showing how a pair of antennas with a shared ground plane may be isolated using a parasitic antenna element formed from a pair of slots in the ground plane that have different lengths in accordance with an embodiment of the present invention.

As shown in FIG. 8, parasitic antenna element 74 may, if desired, be formed from a closed slot such as closed slot 76. Slot 76 is entirely surrounded and enclosed by portions of ground plane 62, so no slot openings such as slot opening 78 of FIG. 6 are present in slot 76 of FIG. 8. In an open slot such as slot 76 of FIG. 6, it may be desirable to configure slot 76 to have a slot length of about one quarter of a wavelength at an operating frequency of interest (i.e., a frequency in a communications band of operation for antennas 56A and 56B). In a closed slot such as slot 76 of FIG. 8, it may be desirable to configure slot 76 to have a slot length of about one half of a wavelength at the operating frequency of interest. Closed slot 76 may have a C-shape as shown in FIG. 9, may have an L-shape, may be straight, may have curved portions, may have an H-shape, or may have other suitable shapes. If desired, parasitic antenna element 74 may include both closed and open slots, closed open slots with multiple branches, etc. The configuration of FIG. 8 is merely illustrative.

In the illustrative configuration for parasitic antenna element 74 of FIG. 9, parasitic antenna element 74 includes multiple slots such as slot 76A and slot 76B. Each slot (in this example) may have a different length and therefore a different frequency response. For example, slot 76A may have a first length L1 and slot 76B may have a second length L2. Length L1 may be less than length L2, so that slot 76A is associated with providing enhanced antenna isolation at a higher operating frequency than slot 76B. By incorporating two slots with different frequency tunings, the overall bandwidth of the isolation provided by parasitic antenna element 74 may be enhanced. In the example of FIG. 9, slots 76A and 76B are open slots having respective ground plane openings 78A and 78B. This is merely illustrative. Slots 76A and/or 76B may be open and/or closed slots, if desired.

Figure 10:
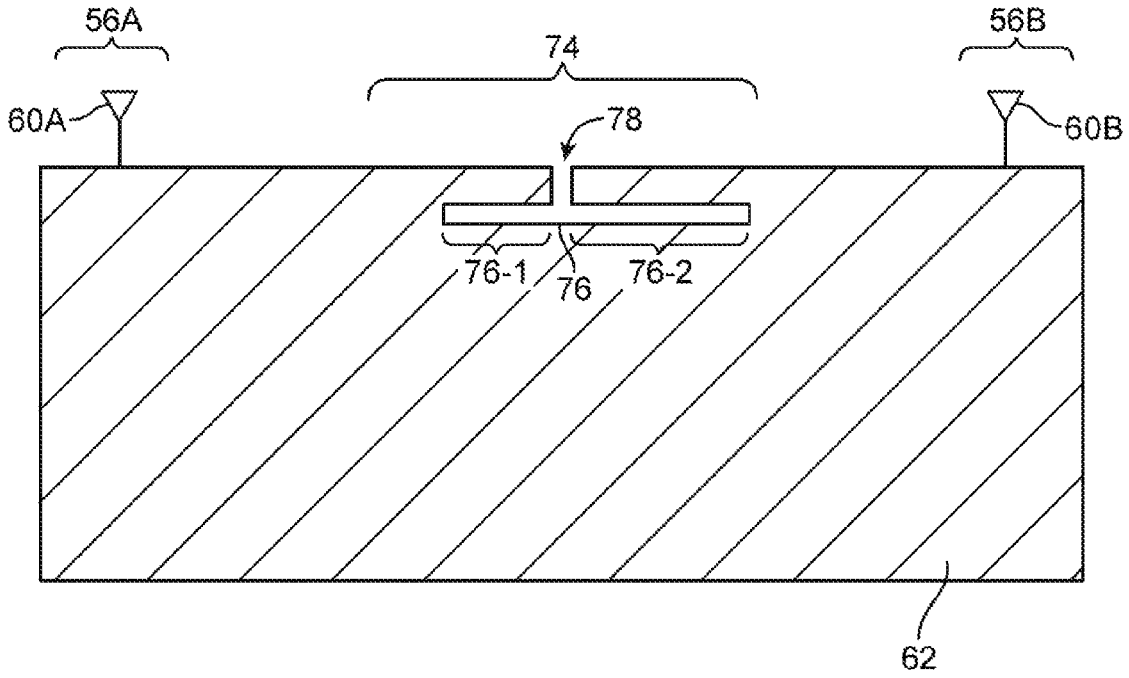
FIG. 10 is a diagram showing how a pair of antennas with a shared ground plane may be isolated using a parasitic antenna element formed from a T-shaped slot in the ground plane that has multiple branches of different lengths in accordance with an embodiment of the present invention.

An illustrative configuration for a slot-based parasitic antenna element in which the parasitic element has a slot with multiple branches (arms) is shown in FIG. 10. As shown in FIG. 10, parasitic antenna element 74 may have a T-shaped slot such as slot 76 that includes first branch 76-1 and second branch 76-2. The lengths of branches 76-1 and 76-2 may be different, so as to give rise to different frequency response contributions for parasitic antenna element 74, thereby enhancing isolation bandwidth.

Figure 11:
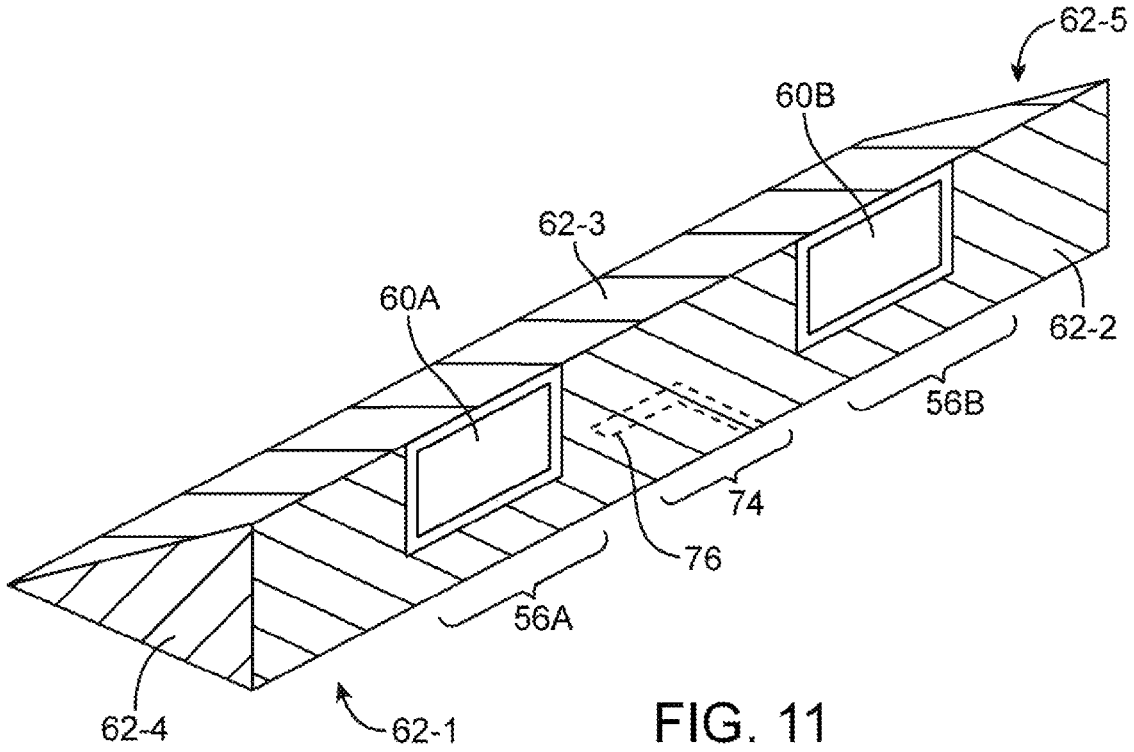
FIG. 11 is a diagram of a pair of antennas backed by antenna cavity structures and an associated slot-based parasitic antenna element of the type that may be used to help isolate the antennas from each other in accordance with an embodiment of the present invention.

If desired, antennas 56A and 56B may be formed using ground plane that is shaped in the form of a cavity (i.e., antennas 56A and 56B may be implemented using cavity-backed antenna designs). This type of configuration is shown in FIG. 11. As shown in FIG. 11, antenna 56A may have antenna resonating element 60A and antenna 56B may have antenna resonating element 60B. Ground plane 62 may be formed from structures that form a hollow triangular prism having base portion 62-1, vertical portion 62-2, and side portion 62-3, and end portions 62-4 and 62-5. Structures 62 may form an antenna cavity for antennas 56A and 56B. Parasitic antenna element 74 may have one or more slots such as slot 76. Slot 76 may be formed in the conductive structures that form antenna ground plane 62. For example, slot 76 may be formed in base portion 62-1.

Antenna resonating elements 60A and 60B and ground plane 62 may be formed from patterned metal traces on a support structure (e.g., a plastic carrier, a glass carrier, a ceramic carrier, a rigid printed circuit board, a flexible printed circuit, or other dielectric support structure). Antenna resonating elements 60A and 60B may, if desired, be planar elements that are oriented perpendicular to slot 76 (i.e., elements 60A and 60B may lie in a plane having a surface normal that is perpendicular to the surface normal for a plane that contains slot 76). Other configurations for antenna resonating elements 60A and 60B may be used, if desired. For example, an antenna cavity for antennas 56A and 56B may be formed using more planar ground plane elements (e.g., to form a rectangular prism), using curved cavity walls, using a combination of curved and flat cavity walls, etc.). The example of FIG. 11 is merely illustrative.

Figure 12:
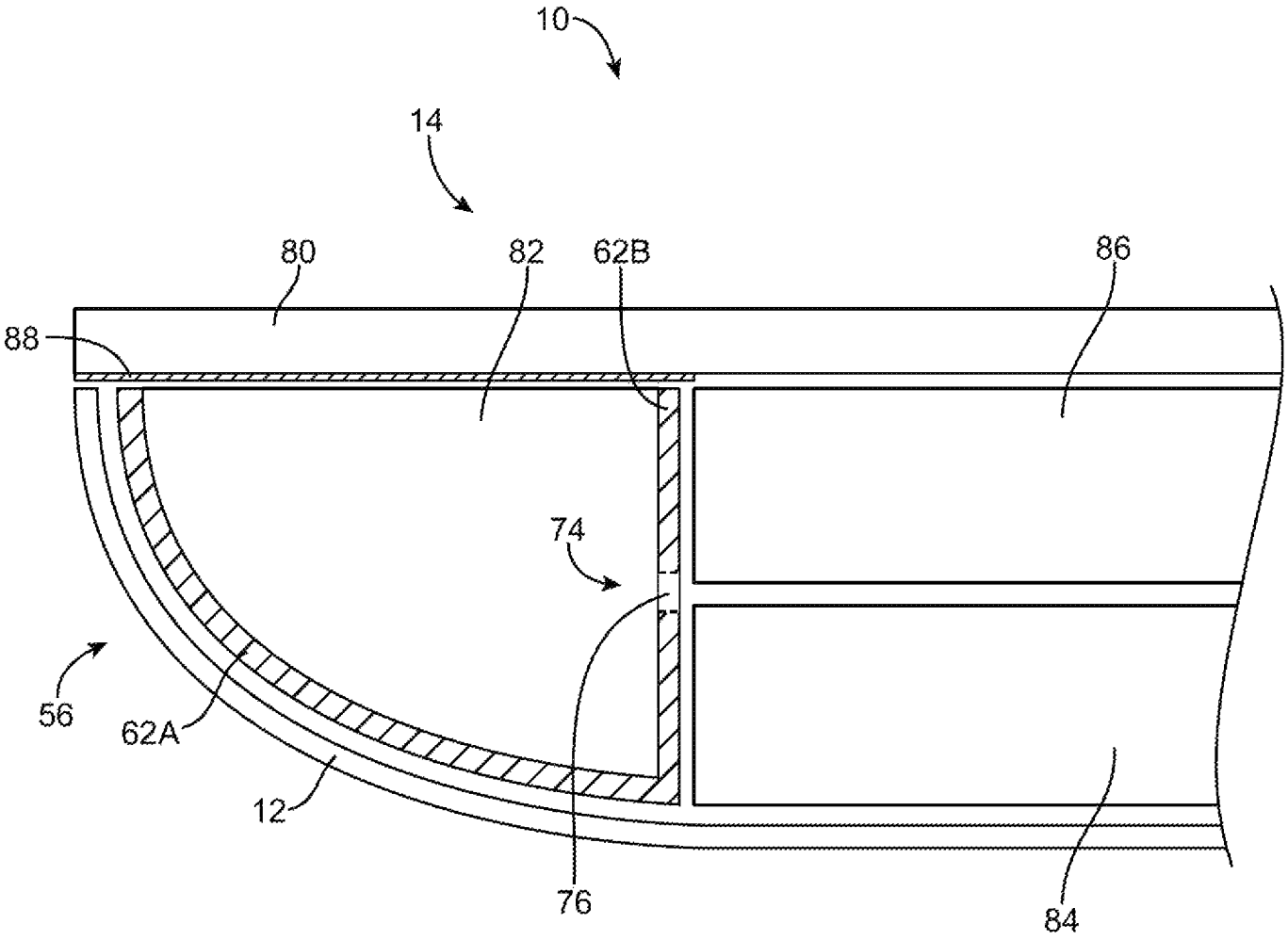
FIG. 12 is a side view of an illustrative electronic device showing how a ground plane structure of the type that may be formed on a dielectric support structure may have a slot-based parasitic antenna element in accordance with an embodiment of the present invention.

A cross-sectional view of a portion of device 10 in the vicinity of an antenna cavity formed from an antenna ground plane that includes slot 76 is shown in FIG. 12. As shown in FIG. 12, display 14 may have display structures 86 and display cover layer 80. Display structures 86 may include an array of display pixels formed from liquid crystal display (LCD) components, electrowetting display components, electrophoretic display components, organic light-emitting diode components, or other display circuitry. Display structures 86 may be covered by display cover layer 80. Display cover layer 80 may be formed from a planar member such as a sheet of clear glass, a transparent layer of plastic, or other cover structures. If desired, a peripheral edge portion of display cover layer 80 may be covered with opaque masking layer 88 to prevent interior portions of device 10 from being visible from the exterior of device 10. Opaque masking layer 88 may be formed from a layer of black ink or plastic other opaque material. Opaque masking material 88 may be radio-transparent for radio-frequency signals being handled by antenna structures 56.

Components 84 may be interposed between display structures 86 and housing 12. Components 84 may include batteries, integrated circuits, printed circuit boards, and other electrical components that include metal. To avoid blocking slot 76, slot 76 may be formed at a location that provides clearance (e.g., a millimeter or more, several millimeters or more, or several centimeters or more) between slot 76 and conductive structures in device 10 such as components 84, housing 12, and display structures 86.

Antenna structures 56 may be formed along the edge of device 10 (e.g., an edge such as edge 42 of FIG. 1 or the edge of a portable device such as a portable computer, tablet computer, etc.) from conductive structures on dielectric carrier 82 (as an example). Carrier 82 may be formed from one or more dielectric members. For example, carrier (support structures) 82 may be formed from a hollow plastic carrier structure, a hollow glass carrier structure, a hollow ceramic carrier structure, structures formed from one or more layers of plastic, glass, or ceramic, structures formed from injection molding, structures formed from printed circuit board material, other dielectric structures, and support structures formed from combinations of such structures. Conductive traces structure on support structures 82 may be used in forming antenna resonating elements 60A and 60B (see, e.g., FIG. 6) and in forming an antenna ground plane. In the example of FIG. 12, antenna structures 56 may include ground plane conductive structures 62A and 62B. Structures 62A and 62B may be used in forming an antenna cavity structure for antennas 56A and 56B. Parasitic antenna element 74 may be formed from slots in conductive structures 62A and/or 62B. For example, parasitic element 74 may be formed from slot 76 in ground plane structure 62B. Antennas 56A and 56B (located out of the plane of the page of FIG. 12) may share ground plane structures 62A and 62B with parasitic element 74.

Figure 13:
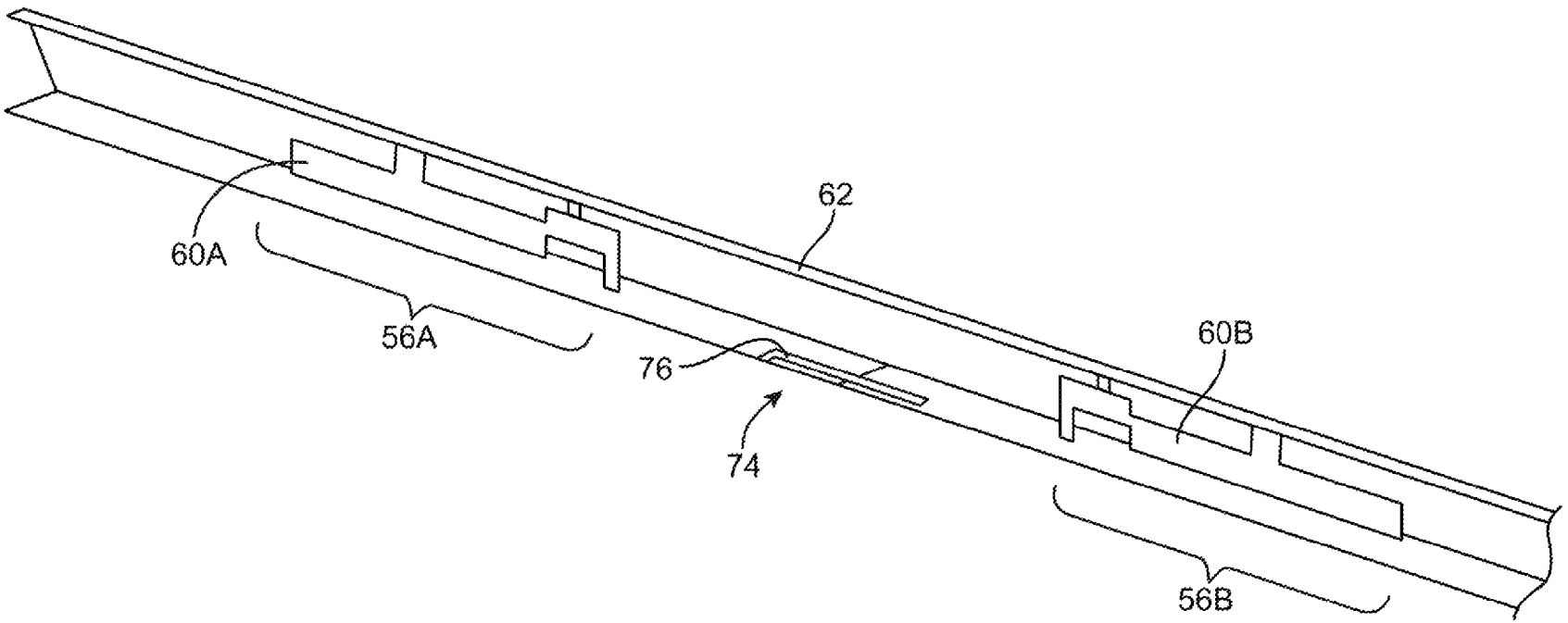
FIG. 13 is a perspective view of a portion of an electronic device showing how a pair of antennas may be isolated using a slot-based parasitic antenna element in accordance with an embodiment of the present invention.

FIG. 13 is a perspective view of illustrative antennas 56A and 56B that are separated by parasitic antenna element 74. Antenna 56A may be formed from antenna resonating element 60A and a portion of conductive antenna ground plane structures 62. Antenna 56B may be formed from antenna resonating element 60B and a portion of conductive antenna ground plane structures 62. Conductive antenna ground plane structures 62 may be formed from structures such as structures 62A and 62B of FIG. 12 or other conductive structures in device 10. For example, antenna ground plane 62 of FIG. 13 may be formed from metal that is part of housing structure 12 in an electronic device such as electronic device 10 of FIG. 1, from traces on dielectric carriers, from traces on printed circuits, from traces on a glass carrier, from traces on a plastic carrier, from traces on a ceramic carrier, or other conductive structures in device 10. Structures 62 of FIG. 13 may, if desired, be located along the edge of device 10 (e.g., in regions such as regions 42 of FIG. 1) or may be located in other portions of device 10.

Figure 14:
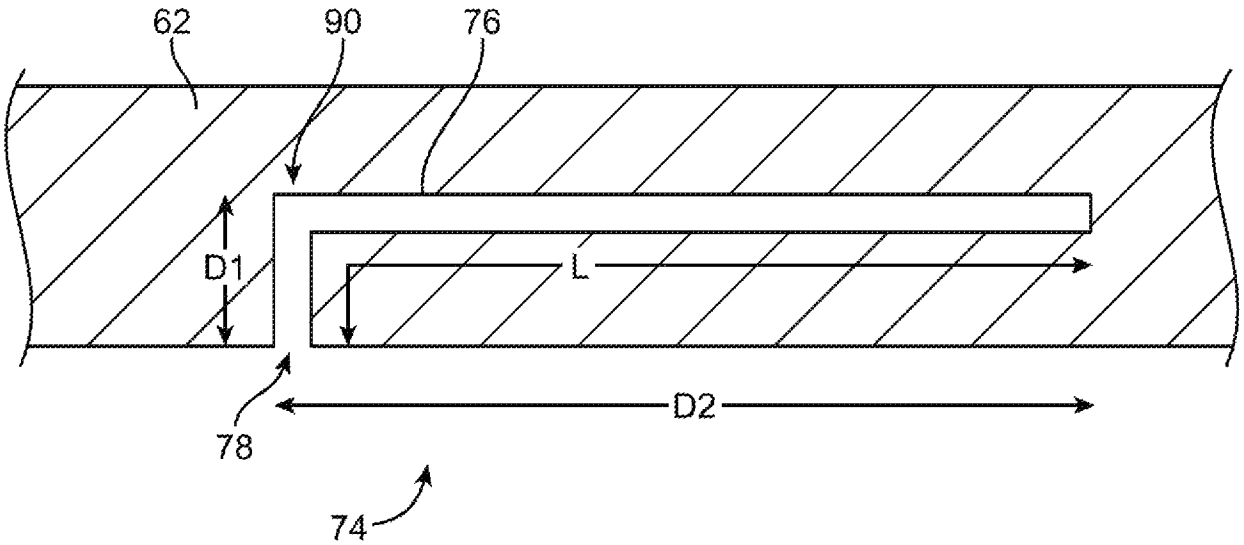
FIG. 14 is a diagram of an illustrative L-shaped slot-based parasitic antenna element in accordance with an embodiment of the present invention.

As shown in FIG. 14, slot 76 of parasitic antenna element 74 of FIG. 13 may be characterized by a length L. The value of length L may be selected so that it is about a quarter of a wavelength at an operating frequency of interest. Slot 76 may be an open slot having an opening in ground plane 62 such as opening 78. There may be one or more bends such as right-angle bend 90 along the length of slot 76. With one suitable arrangement, slot 76 may have an L-shape with one bend (bend 90), a width of less than 2 mm (e.g., 0.1 to 2 mm), a dimension D1 that is about 2 mm (e.g., about 1-5 mm), and a dimension D2 that is about 24 mm (e.g., about 12-28 mm). This size and shape for slot 76 may help provide antenna isolation at frequencies of about 2.4 GHz to 2.5 GHz. Other shapes and sizes may be used for slot 76, if desired (e.g., to cover other operating frequencies).

Figure 15:
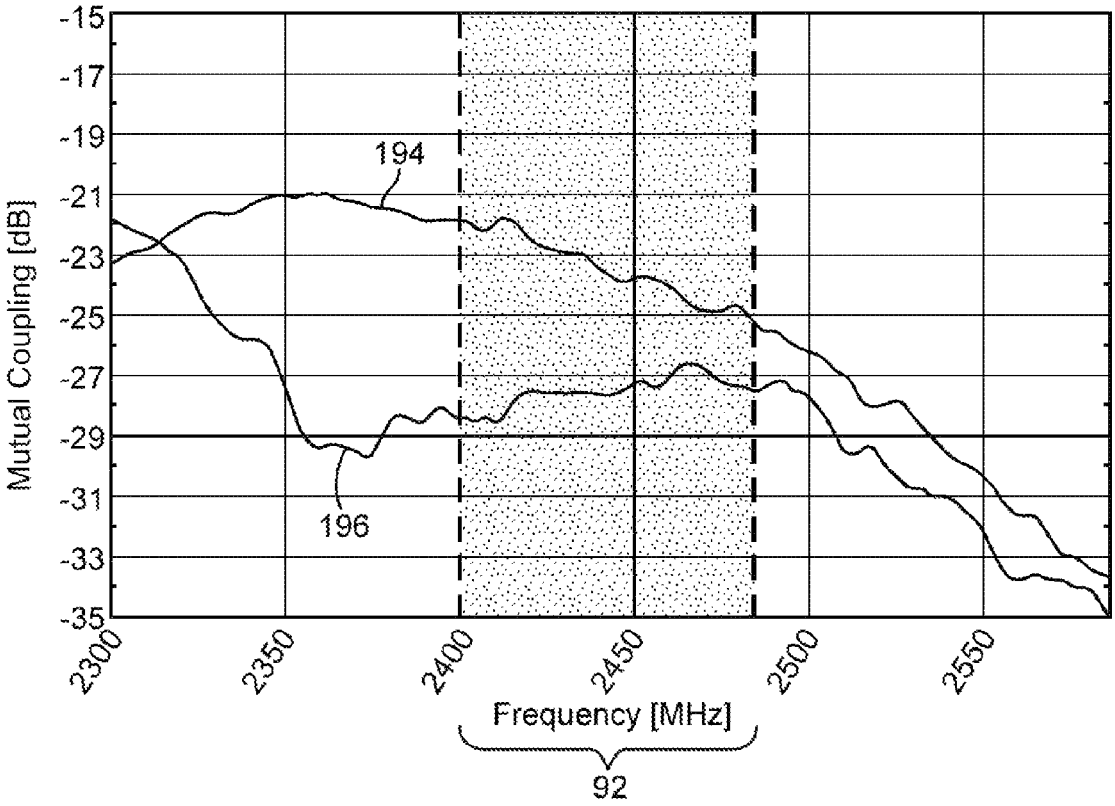
FIG. 15 is a graph in which antenna coupling between a pair of antennas has been plotted as a function of frequency in both the presence and in the absence of a slot-based parasitic antenna element in accordance with an embodiment of the present invention.

FIG. 15 is a graph in which measured antenna coupling between antenna 56A and antenna 56B of FIG. 13 has been plotted as a function of operating frequency. Band 92 corresponds to a communications band of interest (e.g., a wireless local area network band or other band). When antennas 56A and 56B are operated in a system of the type shown in FIG. 13 in which parasitic antenna element 74 is present, the coupling between antennas 56A and 56B may be characterized by a curve such as curve 196. In this situation, antennas 56A and 56B may be well isolated from each other and exhibit satisfactory wireless performance. In a configuration in which antenna resonating element 74 of FIG. 13 is not present, antennas 56A and 56B are not well isolated (in this example) and exhibit significantly more coupling, as shown by curve 194.

Figure 16:
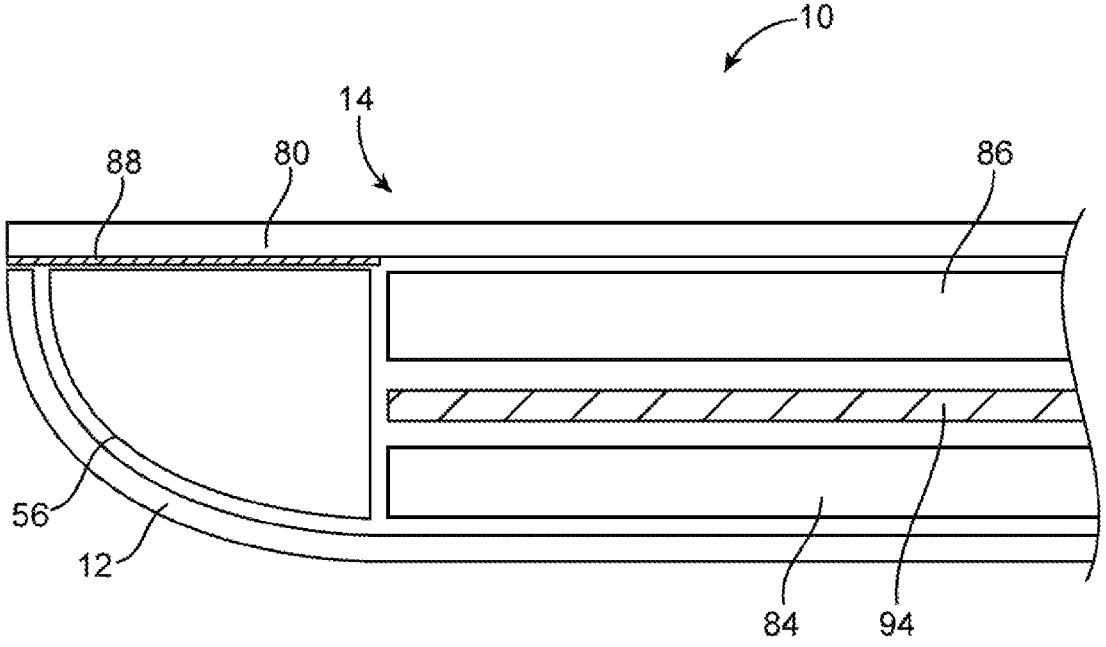
FIG. 16 is a cross-sectional view of a portion of an electronic device having a conductive internal housing structure such as a midplate member that may serve as an antenna ground plane for forming a slot-based parasitic antenna element in accordance with an embodiment of the present invention.

A cross-sectional view of electronic device 10 showing how device 10 may include internal conductive housing structures is shown in FIG. 16. As shown in FIG. 16, device 10 may include antenna structures such as antenna structures 56. Display 14 may include display structures 86 and display cover layer 80. Components 84 may include integrated circuits, printed circuit boards, batteries, and other components. Conductive structures such as conductive structures 94 may be interposed between display structures 86 and components 84. Conductive structures 94 may, as an example, include one or more sheet metal structures or machined metal structures. These structures, which may sometimes be referred to as a midplate or midplate structures may span some or all of the width of device 10 of FIG. 2. For example, structures 94 of FIG. 16 may be welded or otherwise coupled between the left edge of housing 12 of FIG. 2 and the right edge of housing 12 of FIG. 2 without significantly blocking regions 24 and 26.

Figure 17:
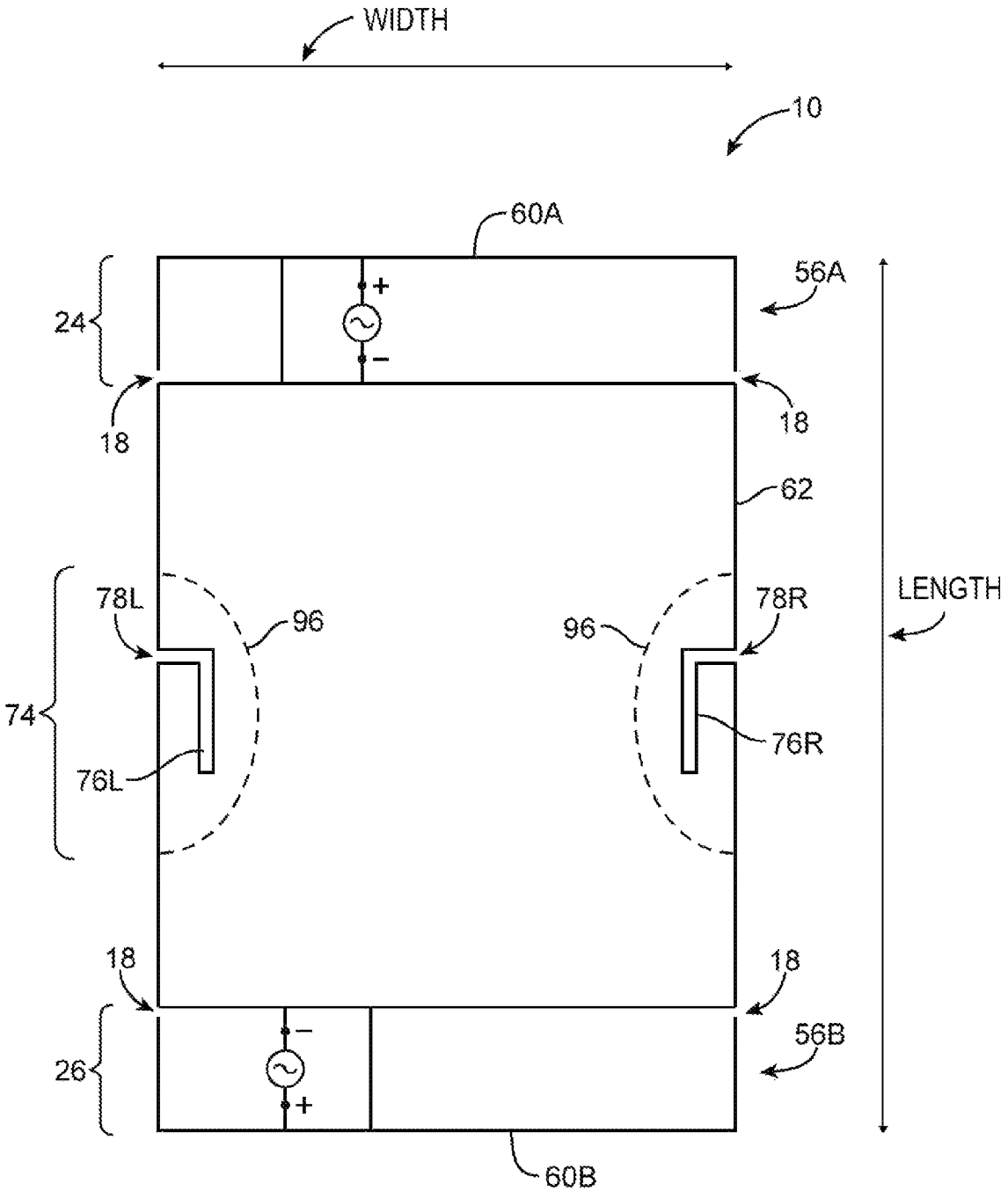
FIG. 17 is a diagram showing how a midplate structure of the type shown in FIG. 16 or other antenna ground plane structure may be used in forming slot-based parasitic antenna elements to help isolate antennas in a device in accordance with an embodiment of the present invention.

Structures such as structures 94 of FIG. 16 and/or other conductive structures associated with device 10 (e.g., conductive housing structures 12, metal traces on dielectric structures, etc.) may be used in forming antenna ground plane 62. As an example, structures 94 may be used in forming ground plane 62 of FIG. 17. As shown in FIG. 17, device 10 of FIG. 17 may include antenna structures such as antenna structures 56A and antenna structures 56B. Antenna structures 56A may be formed from antenna resonating element 60A in region 24 and an associated portion of ground plane 62. Antenna structures 56B may be formed from antenna resonating element 60B in region 26 and an associated portion of ground plane 62. Regions 24 and 26 and respective antennas 56A and 56B may be located at opposing ends of device 10.

To enhance isolation between antennas 56A and 56B, device 10 of FIG. 17 may be provided with parasitic antenna element 74. Parasitic antenna element 74 may be formed from one or more slots in ground plane 62. As shown in FIG. 17, for example, parasitic antenna element 74 may include a first slot such as slot 76L and a second slot such as slot 76R. Slot 76L may be located along the left-hand edge of ground plane 62 and may have an associated opening such as opening 78L. Slot 76R may be located along the right-hand edge of ground plane 62 and may have an associated opening such as opening 78R. Slots 76L and 76R may have the same length or may have different lengths to broaden isolation bandwidth. To ensure that slots 76L and 76R operate effectively, conductive structures such as display structures 86 and components 84 may be confined to regions outside of keep-out regions 96.

Figure 18:
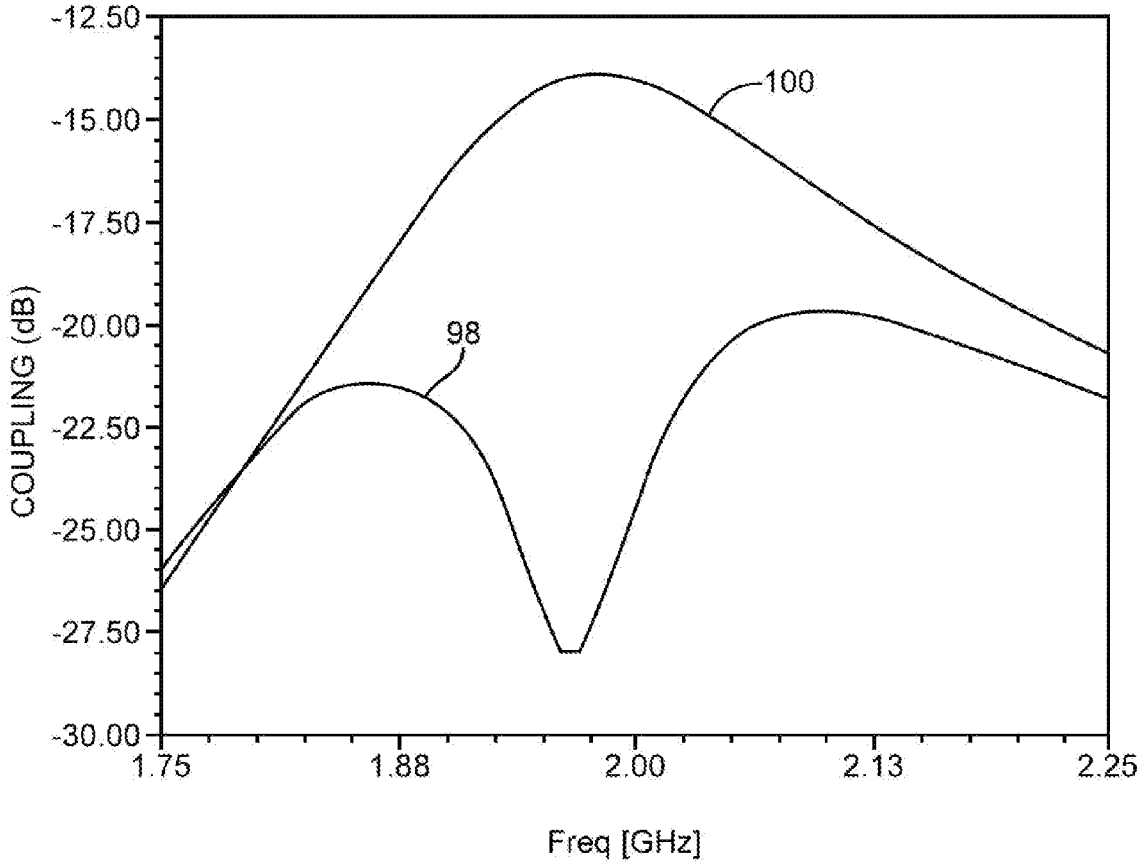
FIG. 18 is a graph in which antenna coupling between a pair of antennas has been plotted as a function of frequency in both the presence and in the absence of slot-based parasitic antenna element structures of the type shown in FIG. 17 in accordance with an embodiment of the present invention.

FIG. 18 is a graph in which coupling between a first antenna (i.e., antenna 56A) and a second antenna (i.e., antenna 56B) in a configuration of the type shown in FIG. 17 has been plotted as a function of operating frequency. Antennas 56A and 56B may be, for example, cellular telephone antennas operating at frequencies from 1750 MHz to 2250 MHz (as an example). Curve 100 represents the coupling between antenna structures 56A and 56B in the absence of slot-based parasitic antenna element 74. Curve 98 represents the minimized coupling between antenna structures 56A and 56B that may be obtained when ground plane 62 has been configured to form slots such as slots 76A and 76B for parasitic antenna isolation element 74.

Figure 19:
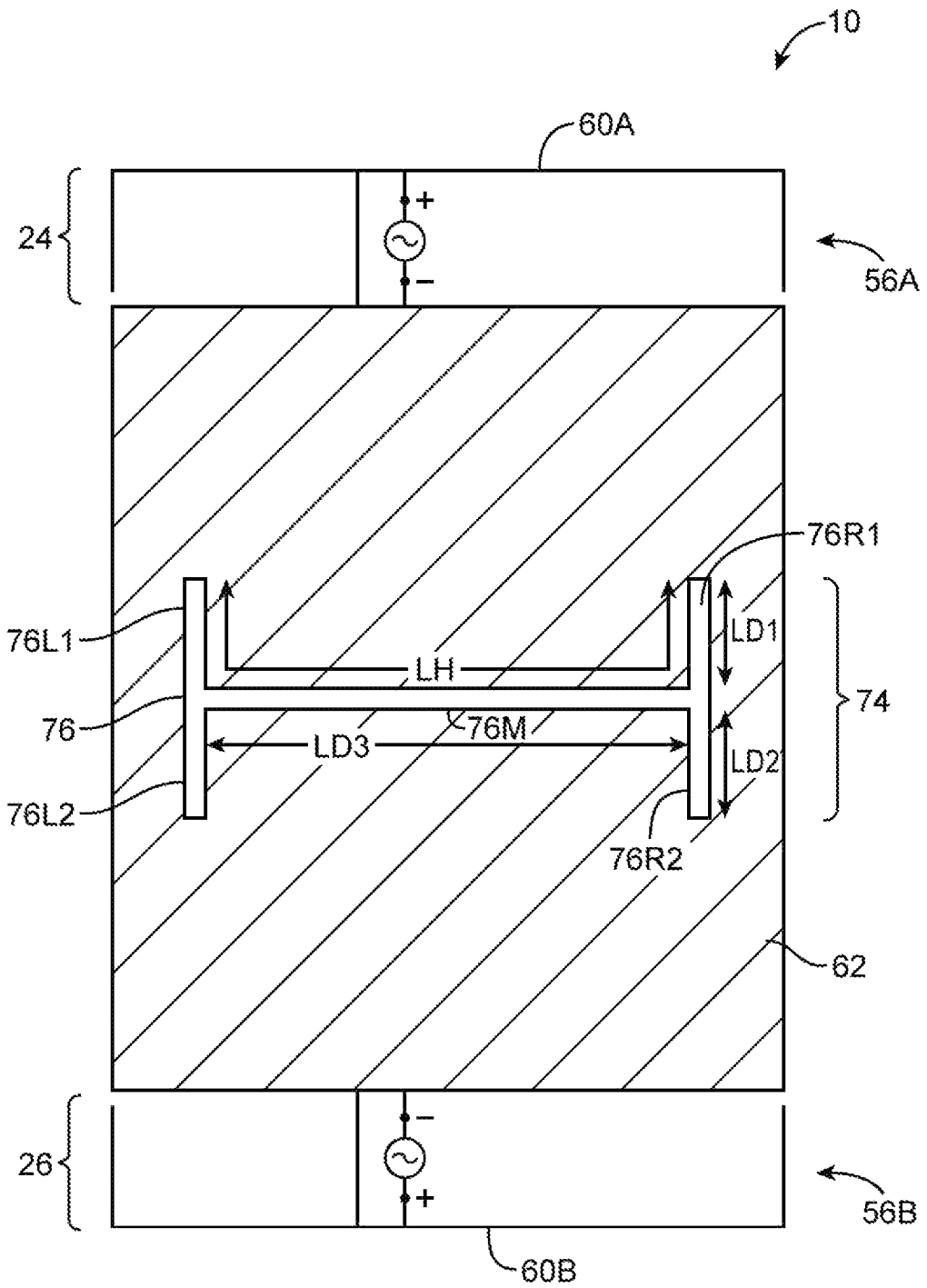
FIG. 19 is a diagram showing how an antenna ground structure such as a midplate structure of the type shown in FIG. 16 may be used to form a slot-based parasitic antenna element with an H-shaped closed slot that enhances isolation between antennas in an electronic device in accordance with an embodiment of the present invention.

In configurations for device 10 where it may be difficult to form unobstructed slot openings such as openings 78L and 78R of FIG. 17, it may be desirable to form slot structures for parasitic antenna element 74 using closed slot arrangements. FIG. 19 is a diagram showing how parasitic antenna element 74 may be formed using an H-shaped closed slot. As shown in FIG. 19, slot 76 in ground plane 62 of device 10 in FIG. 19 may have a horizontal main arm such as arm 76M of length LD3. Arm 76M may extend horizontally between opposing vertical segments. The left-hand vertical segment of slot 76 may include first arm 76L1 and second arm 76L2. Arm 76L1 may extend upwards from the left-hand end of main arm 76M. Arm 76L2 may extend downwards from the left-hand end of arm 76M. The right-hand vertical segment of slot 76 may include first arm 76R1 and second arm 76R2. Arm 76R1 may extend upwards from the right-hand end of main arm 76M. Arm 76R2 may extend downwards from the right-hand end of arm 76M.

Arms 76L1, 76L2, 76R1, and 76R2 may have four different lengths, three different lengths, two different lengths, or may all be of equal size. As an example, arms 76L1 and 76R1 may be of equal size (length LD1) and arms 76L2 and 76R2 may be of equal size (length LD2, which may be smaller or larger than length LD1). The H-shape of slot 76 may form upper and lower C-shaped slots that overlap along common main arm 76M. In a configuration in which the upper arms of the H have equal lengths LD1 and the lower arms of the H have equal lengths LD2, the length LH of the upper C-shaped slot may be equal to 2LD1+LD3 and the length of the lower C-shaped slot may be equal to 2LD2+LD3. Length LD1 may be equal to length LD2 or different lengths may be used to broaden isolation bandwidth. To ensure satisfactory antenna isolation, the lengths of the upper and lower C-shaped portions of slot 76 may be configured to be about one half of a wavelength at an operating frequency of interest. In configurations for closed multi-arm slot 76 of FIG. 19 with other arm lengths, isolation may be provided at different operating frequencies. The H-shaped slot of FIG. 19 is merely illustrative. In general, parasitic element 74 may be formed by a single closed slot, two closed slots, three or more closed slots, one open slot, two open slots, three or more open slots, one or more slots with a single arm, one or more slots with multiple arms to enhance isolation bandwidth, and/or combinations of slots such as these.

Figure 20:
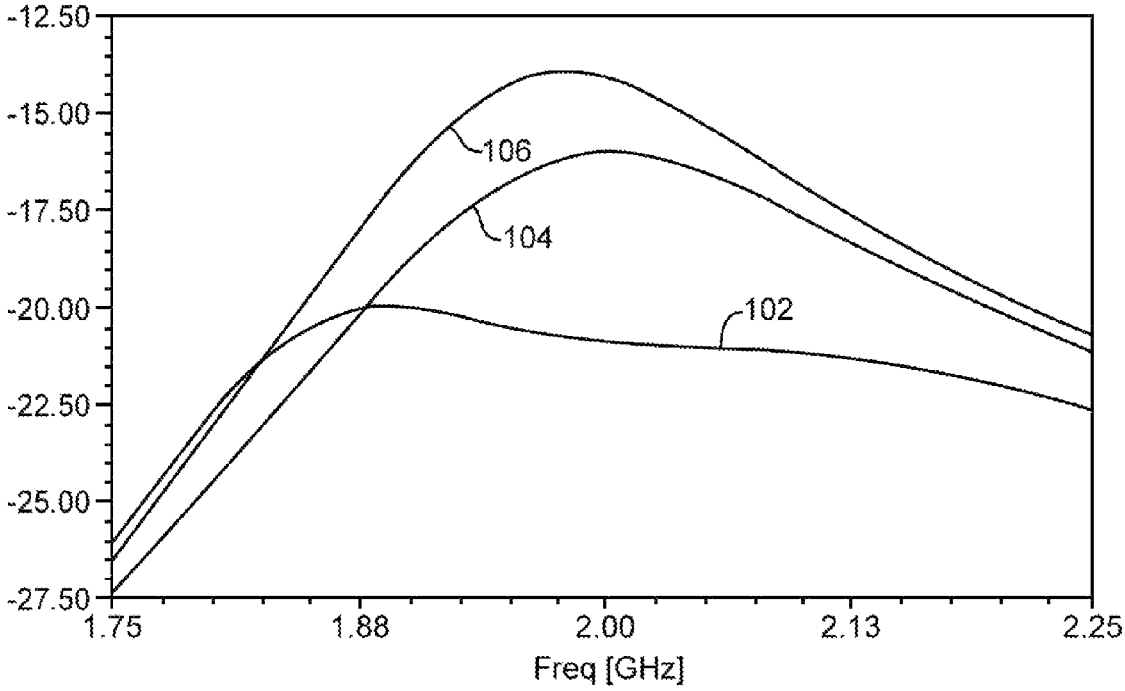
FIG. 20 is a graph in which antenna coupling between a pair of antennas has been plotted as a function of frequency with in the presence of different types of slot-based parasitic antenna elements in accordance with an embodiment of the present invention.

FIG. 20 is a graph in which coupling between a first antenna (i.e., antenna 56A) and a second antenna (i.e., antenna 56B) in a configuration of the type shown in FIG. 19 has been plotted as a function of operating frequency. Antennas 56A and 56B may be, for example, cellular telephone antennas operating at frequencies from 1750 MHz to 2250 MHz (as an example). Curve 106 represents the coupling between antenna structures 56A and 56B in the absence of slot-based parasitic antenna element 74. Curves 104 and 102 represent the coupling between antenna structures 56A and 56B in configurations for slot 76 of FIG. 19 in which LD1 and LD2 are equal. Curve 104 corresponds to a configuration in which LD1 and LD2 are each equal to 10 mm. Curve 102 corresponds to a configuration in which LD1 and LD2 are each equal to 25 mm. As curves 104 and 102 demonstrate, the use of slot-based parasitic antenna element 74 may enhance isolation between antennas 56A and 56B.

The foregoing is merely illustrative of the principles of this invention and various modifications can be made by those skilled in the art without departing from the scope and spirit of the invention.

What is claimed is:

1. An electronic device having a length, a width that is less than the length, and a height that is less than the width, comprising:

a conductive housing having first and second ends;

an antenna ground plane;

a first antenna resonating element that forms a first portion of the conductive housing at the first end and that extends across an entirety of the width of the electronic device;

a second antenna resonating element that forms a second portion of the conductive housing at the second end and that extends across the entirety of the width of the electronic device; and a slot-based parasitic antenna element formed from slot structures in the antenna ground plane, wherein the first antenna resonating element and the antenna ground plane form a first antenna, the second antenna resonating element and the antenna ground plane form a second antenna, and the slot-based parasitic antenna element is configured to serve as an antenna isolation element to minimize coupling between the first and second antennas.

2. The electronic device defined in claim 1 wherein the slot structures comprise at least one closed slot in the antenna ground plane between the first and second ends.

3. The electronic device defined in claim 2 further comprising an internal metal housing structure that forms at least part of the antenna ground plane, wherein the closed slot is formed in the internal metal housing structure.

4. The electronic device defined in claim 3 wherein the internal metal housing structure comprises at least one planar metal layer in which the closed slot is formed and wherein the electronic device comprises cellular telephone transceiver circuitry coupled to the first and second antennas.

5. The electronic device defined in claim 1, wherein the first portion of the conductive housing formed from the first antenna resonating element comprises a first external surface of the electronic device and the second portion of the conductive housing formed from the second antenna resonating element comprises a second external surface of the electronic device that opposes the first external surface.

6. The electronic device defined in claim 1, wherein the first and second antenna resonating elements each extend across an entirety of the height of the electronic device.

7. The electronic device defined in claim 1, wherein the first portion of the conductive housing that is formed from the first antenna resonating element runs along at least first, second, and third external surfaces of the electronic device.

8. The electronic device defined in claim 7, wherein the second portion of the conductive housing that is formed from the second antenna resonating element runs along at least the first and second external surfaces and a fourth external surface of the electronic device.

9. The electronic device defined in claim 7, wherein the first external surface is substantially parallel to the second external surface and the third external surface is substantially perpendicular to the first and second external surfaces.

10. The electronic device defined in claim 7, wherein the slot structures comprises a first slot in the antenna ground plane between the first and second ends adjacent to the first external surface of the electronic device and a second slot in the antenna ground plane between the first and second ends adjacent to the second external surface of the electronic device.

11. The electronic device defined in claim 1, where the slot structures comprise a C-shaped closed slot.

* * * * *